US011471782B2

(12) United States Patent
Rubin et al.

(10) Patent No.: US 11,471,782 B2
(45) Date of Patent: Oct. 18, 2022

(54) SPIN AND CATCH GAME

(71) Applicant: CATCHUP TOYS LIMITED, Hong Kong (CN)

(72) Inventors: Guy Rubin, Hod Hasharon (IL); Avi Resch, Tel Aviv (IL)

(73) Assignee: CATCHUP TOYS LIMITED, San Po Kong Kowloon (HK)

( * ) Notice: Subject to any disclaimer, the term of this patent is extended or adjusted under 35 U.S.C. 154(b) by 549 days.

(21) Appl. No.: 16/486,934

(22) PCT Filed: Feb. 18, 2018

(86) PCT No.: PCT/IB2018/050987
§ 371 (c)(1),
(2) Date: Aug. 19, 2019

(87) PCT Pub. No.: WO2018/150382
PCT Pub. Date: Aug. 23, 2018

(65) Prior Publication Data

US 2021/0129010 A1 May 6, 2021

Related U.S. Application Data

(60) Provisional application No. 62/460,919, filed on Feb. 20, 2017.

(51) Int. Cl.
*A63F 9/16* (2006.01)
*A63F 9/30* (2006.01)
(Continued)

(52) U.S. Cl.
CPC ..... *A63H 1/00* (2013.01); *A63F 9/16* (2013.01); *A63F 9/30* (2013.01); *A63H 1/20* (2013.01);
(Continued)

(58) Field of Classification Search
CPC ..... A63F 9/16; A63F 9/30; A63F 9/34; A63F 9/305; A63F 7/0088; A63F 7/068; A63H 1/00; A63H 1/20; A63H 33/26
See application file for complete search history.

(56) References Cited

U.S. PATENT DOCUMENTS 1,257,045 A * 2/1918 Stotler ..... A63F 5/04 5/164.1
1,783,627 A * 12/1930 Raimondi ..... A63H 1/00 446/256

(Continued)

FOREIGN PATENT DOCUMENTS

CN 201423165 Y 3/2010
CN 201791382 U 4/2011
WO WO-2006087527 A2 * 8/2006 ..... A63H 1/18

*Primary Examiner* — Laura Davison
(74) *Attorney, Agent, or Firm* — William H. Dippert; Laurence A. Greenberg; Werner H. Stemer

(57) ABSTRACT

A spinner (100) adapted to spin on a surface comprising: a spinning mechanism (300) activated by a string (142); a structure encapsulating the spinning mechanism (300); a plurality of tentacles (110) having two ends, wherein each tentacle (110) is in connected to the structure on one end and terminated with a connector on the free end; a flywheel (122) having a tip (121), wherein the flywheel (122) is connected to the spinning mechanism (300) from the opposite side of the tip (121); and wherein upon pulling the string (142) the spinner (100) spins, wherein the tip (121) is in contact with the surface and the plurality of tentacles (110) are slightly elevated above the surface while the spinner (100) spins.

5 Claims, 4 Drawing Sheets

(51) Int. Cl.
*A63H 1/00* (2019.01)
*A63H 1/20* (2006.01)
*A63H 33/26* (2006.01)

(52) U.S. Cl.
CPC ..... *A63H 33/26* (2013.01); *A63F 2250/601* (2013.01)

(56) References Cited

U.S. PATENT DOCUMENTS 2,879,066 A * 3/1959 Sutherland ..... A63F 9/16 446/256
3,316,672 A * 5/1967 Dixon ..... A63H 1/00 446/258
3,425,694 A * 2/1969 Norris ..... A63F 9/34 273/127 R
3,879,887 A * 4/1975 Brookson, Jr. ..... A63H 1/00 446/256
4,802,668 A * 2/1989 Kobayashi ..... A63F 9/30 273/447
6,520,827 B1 * 2/2003 Liu ..... A63H 1/00 446/124
6,530,817 B1 * 3/2003 Winslow ..... A63H 1/00 446/259
7,740,518 B2 * 6/2010 Elliott ..... A63H 1/04 446/256
10,525,367 B2 * 1/2020 Takahashi ..... A63H 1/04
2006/0207499 A1 9/2006 Rogers et al.
2008/0026670 A1 * 1/2008 de la Torre ..... A63H 13/06 446/353
2012/0244781 A1 9/2012 Smith
2016/0089613 A1 * 3/2016 Stubenfoll ..... A63H 31/00 446/239

* cited by examiner

SPIN AND CATCH GAME

CROSS-REFERENCE TO RELATED PATENT APPLICATIONS

This patent application is a U.S. National Phase filing under 35 U.S.C. § 371 of PCT Patent Application No. PCT/IB2018/050987, filed Feb. 18, 2018, which is based upon and claims the priority of U.S. Provisional Patent Application Ser. No. 62/460,919, filed Feb. 20, 2017, each of which is incorporated herein by reference in its entirety.

TECHNICAL FIELD

The present disclosed subject matter relates to recreation games. More particularly, the present disclosed subject matter relates to non-electric game devices and methods for playing with such devices.

BACKGROUND

Children enjoy all sorts of games; however, children also have lots of energy and computer games don't involve much in the way of physical energy. It is also important to note that many have criticized the spread of computer games because they are usually played solo; thus, another important aspect of socializing by play is neglected. Parents, who want their kids to develop physically and socially, not just acquire rapid hand-eye coordination from shooting virtual monsters; encourage their kids to play traditional games. In fact, there is a bit of a backlash against computer and console gaming, for fear that too much computer and video gaming is unhealthy for children. Traditional game play is in a state of revival throughout the world, these games appeal because of their simplicity, fun to play, and how they allow kids to expend excess energy. Moreover, traditional game devices allow children to socialize and interact with their peers. Team games encourage cooperation and sharing as well. Childhood obesity, which is becoming more and more widespread, is strongly correlated to video game and TV use. It is desirable to induce interaction between children to develop their social skills and dexterity by an exciting game having a simple mechanism.

BRIEF SUMMARY

According to a first aspect of the present disclosed subject matter, a spinner adapted to spin on a surface comprising: a spinning mechanism activated by a string; a structure encapsulating the spinning mechanism; a plurality of tentacles having two ends, wherein each tentacle is connected to the structure on one end and terminated with a magnet on the opposite end; a flywheel having a tip, wherein the flywheel is connected to the spinning mechanism from the opposite side of the tip; and wherein upon pulling the string the spinner spins, wherein the tip is in contact with the surface and the plurality of tentacles are slightly elevated above the surface while the spinner spins.

In some exemplary embodiments, the flywheel is configured to be replaced with a flywheel having different properties wherein the properties are selected from the group consisting of: sustaining spinning speed; sustaining spinning duration; and a combination thereof.

In some exemplary embodiments, the spinning mechanism further comprises a ratchet configured to enable the pulling the string a plurality of times to increase spinning speed and spinning duration.

In some exemplary embodiments, the tip is replicable for adjusting the spinner to different surfaces.

In some exemplary embodiments, the opposite end is terminated with a ferromagnetic material.

In some exemplary embodiments, the structure has a form factor resembling a figure selected from the group consisting of: a spider, an insect having a plurality of tentacles, an animal, a monster, a superhero, imaginary figure, a dome, a sphere, a cone, a pear, an insect abdomen, an insect thorax, and any combination thereof.

According to another aspect of the present disclosed subject matter, a spin and catch game comprising: at least one spinner; and a plurality of tokens adapted to be magnetically attracted by a tentacle while sliding on the surface under the plurality of tentacles are slightly elevated above the surface while the spinner spins.

In some exemplary embodiments, a portion of each token is made of either a magnet or a ferromagnetic material.

In some exemplary embodiments, each token is made of either a magnet or a ferromagnetic material.

In some exemplary embodiments, a value of a token of the plurality of tokens is selected from a group consisting of: a positive numeric value; a negative numeric value; a joker; and any combination thereof, or the like.

In some exemplary embodiments, each token graphically decorated with figures selected from the group consisting of: wild looking creatures, cartoon, animals, emojis, superheroes and any combination thereof.

According to yet another aspect of the present disclosed subject matter, a method for playing the spin and catch game by players comprising a user and at least one opponent, the method comprising: providing the user with at least one spinner and a plurality tokens having positive value; providing the at least one opponent with a plurality tokens having negative value; pulling the string, by the user, to spin the spinner and placing the spinner on the surface wherein the tip is in contact with the surface and the plurality of tentacles are slightly elevated above the surface; sliding tokens on the surface toward the tentacles by the users in order for the token to be caught by any tentacle until the spinner stop spinning.

In some exemplary embodiments, each user of the group of users take turns in spin the spinner, and wherein a winning user is a user who accumulated a highest sum of the values of tokens caught in its turn.

In some exemplary embodiments, the at least one opponent slide tokens having negative value to be caught by the any tentacle.

In some exemplary embodiments, the at least one opponent slide tokens having negative value to knock off tokens having positive value; already caught by the any tentacle.

In some exemplary embodiments, catching a joker grants the user extra turn.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the drawings.

DETAILED DESCRIPTION

Figure 1A:
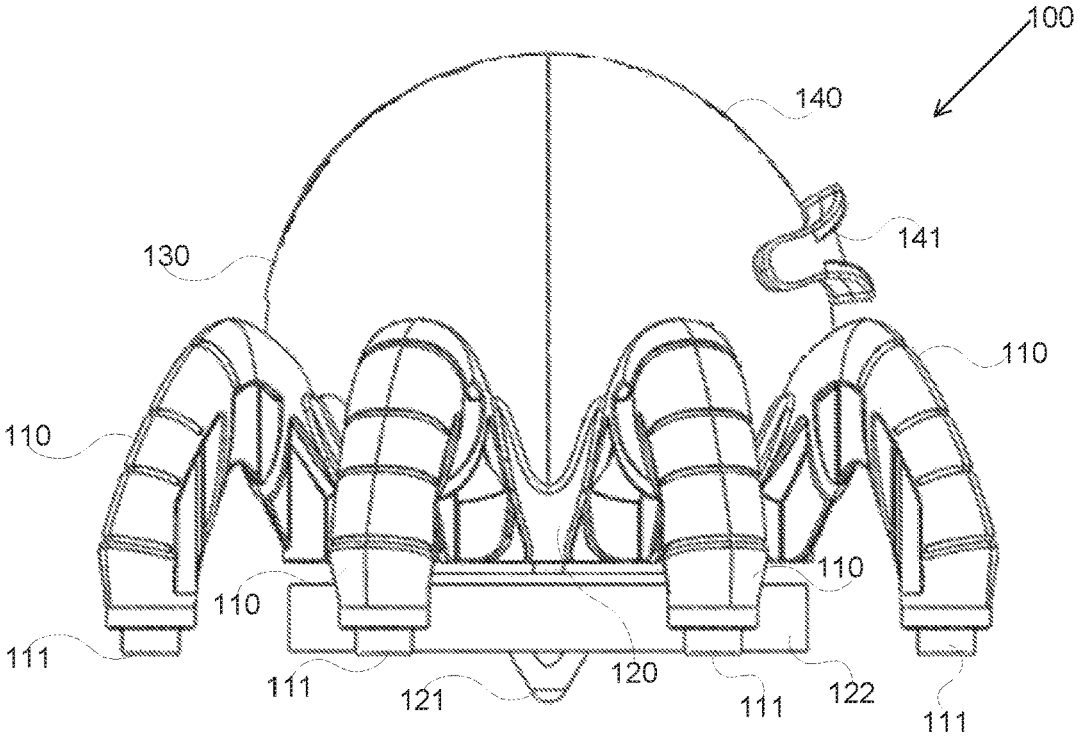
FIG. 1A shows a front view of a spinner, in accordance with some exemplary embodiments of the disclosed subject matter.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The terms "comprises", "comprising", "includes", "including", and "having" together with their conjugates mean "including but not limited to". The term "consisting of" has the same meaning as "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this disclosed subject matter may be presented in a range format. It should be understood that the description in range format is merely for convenience and brevity and should not be construed as an inflexible limitation on the scope of the disclosed subject matter. Accordingly, the description of a range should be considered to have specifically disclosed all the possible sub-ranges as well as individual numerical values within that range.

It is appreciated that certain features of the disclosed subject matter, which are, for clarity, described in the context of separate embodiments, may also be provided in combination in a single embodiment. Conversely, various features of the disclosed subject matter, which are, for brevity, described in the context of a single embodiment, may also be provided separately or in any suitable sub-combination or as suitable in any other described embodiment of the disclosed subject matter. Certain features described in the context of various embodiments are not to be considered essential features of those embodiments, unless the embodiment is inoperative without those elements.

The present disclosure depicts an action game which may comprise, a spinner and collectable tokens. The game may combine strategies, competitiveness and dexterity. The spin and catch game may mimic a jungle atmosphere where a predator, i.e. spinner, hunt and collect wild looking creatures, i.e. tokens, passing in their jungle path, however the spinner should avoid catching wrong tokens. In some exemplary embodiments, one or more players may play the game, each player spins, in turn, the spinner and letting it catch as many tokens, having positive point, for gaining the highest score in each turn. Wherein the score may be determined by the face value sum of the caught tokens, while trying to decrease the opponent's points with the joker tokens. The game may provide basic mathematics calculation formats to children players. In some exemplary embodiments, the game may combine collectible metal token lines of different content worlds or brands.

The spin and catch game may be provided with at one spinner and a plurality of tokens, having different, positive or negative, numerical values, as well as jokers. In some exemplary embodiments, the game may be played on the floor or any surface, large enough, to contain the plurality of tokens and the spinning spinner.

In some exemplary embodiments of the disclosed subject matter, the spinner may comprise magnets at the tip of its legs; to which tokens, made of ferromagnetic material; may be attracted. While the spinner spins, players may slide tokens under the magnets of the spinner so the tokens may be "caught" by the spinner magnets. Additionally, or alternatively, the tokens may be magnets and the tips of the spinner legs may be made of ferromagnetic material.

In some exemplary embodiments, the spinner may comprise a spinning mechanism which may be mechanically activated by pulling a string or any other manual method, known in the art, for mechanically spinning the spinner. Additionally, or alternatively, an electro-mechanic apparatus, such as an actuator, a battery powered motor, and a combination thereof, may be utilized for spinning the spinner. In some exemplary embodiments, the spinner may comprise a replaceable weight for allowing reconfigurable spinning speed and duration.

A spinner according to the disclosed subject matter is adapted to spin on a surface. The spinner comprises:

- a spinning mechanism;
- a plurality of tentacles, each having one end associated with the spinning mechanism and a free end provided with a connector; and a flywheel having a tip, wherein the flywheel is connected to the spinning mechanism on an opposite side of the tip;

wherein activating the spinning mechanism causes the spinner to spin on the tip that is in contact with the surface and the plurality of tentacles are slightly elevated above the surface.

Figure 1B:
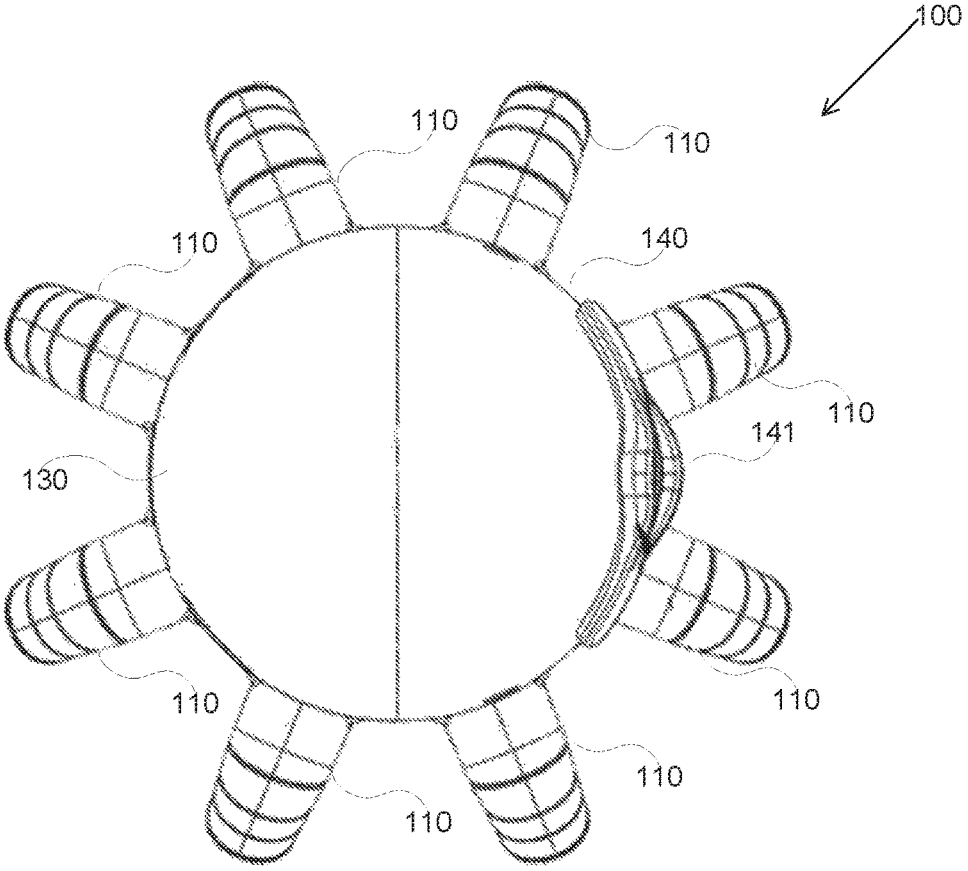
FIG. 1B shows a top view of the spinner, in accordance with some exemplary embodiments of the disclosed subject matter.
Figure 1C:
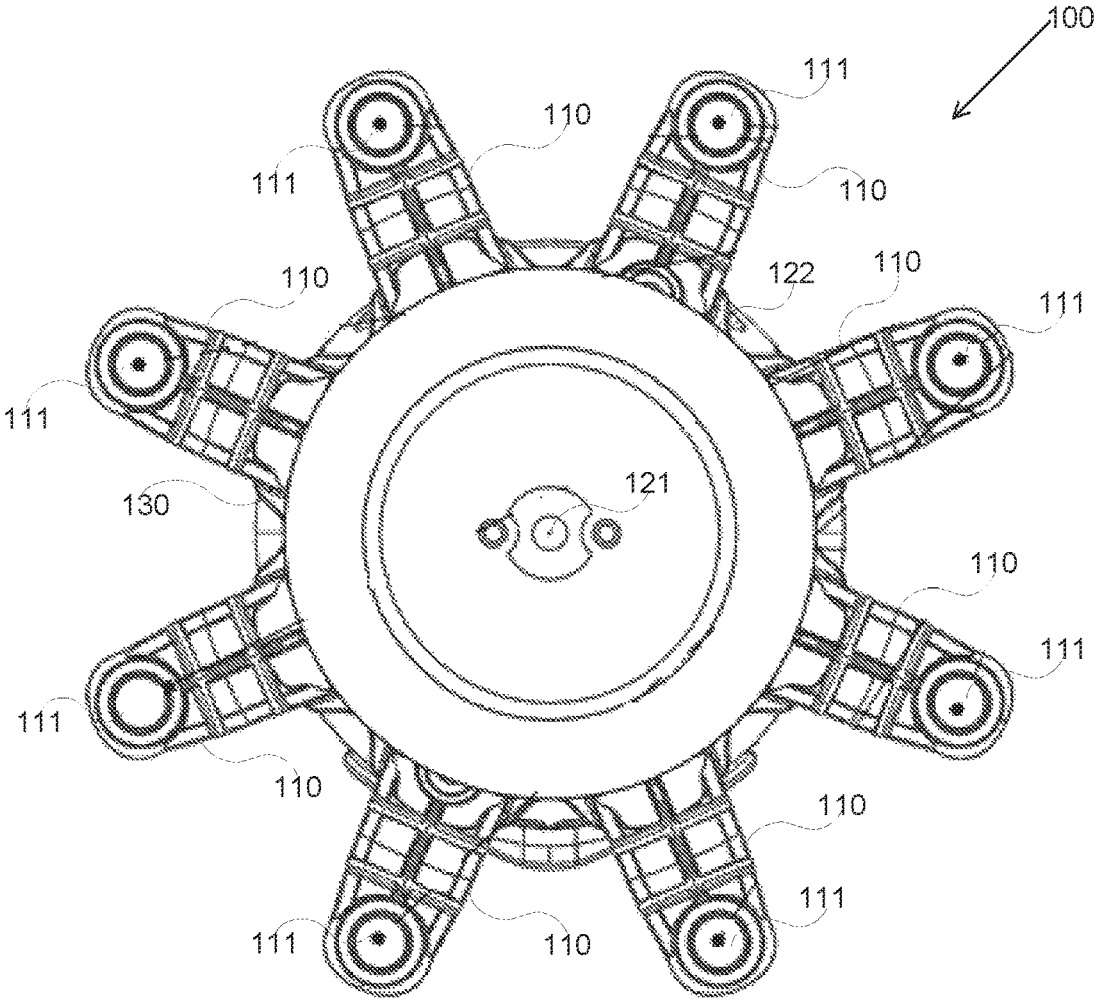
FIG. 1C shows a bottom view of the spinner, in accordance with some exemplary embodiments of the disclosed subject matter.

Referring now to FIGS. 1A-1C, showing a front, top and bottom views, respectively, of a spinner 100, in accordance with some exemplary embodiments of the disclosed subject matter. The structure components of the spinner 100 may comprise a body 120, a left shell 130 a right shell 140 and a plurality of tentacles 110.

In some exemplary embodiments, the material from which the body 120, the left shell 130, the right shell 140, the tentacles 110, may be made of polymers, such as nylon, polyethylene, polyester, Teflon, polyurethane, epoxy, acrylonitrile butadiene styrene (ABS), polyvinyl chloride (PVC), any combination thereof, or the like. In some exemplary embodiments, the listed above structure components of spinner 100 may be produced in a process, such as injection molding, machining, blow molding, compression molding, extrusion molding, laminating, matrix molding, roto-molding, any combination thereof, or the like.

It will be appreciated that, the structure of spinner 100 may resemble a figure of a spider, or other figures, such as an insect having a plurality of tentacles, an animal, a monster, a superhero, imaginary figure, a octopus, and any combination thereof, or the like. In some exemplary embodiments, the plurality of tentacles 110 may be either connected to body 120 or an integral part of it. Additionally, the length, form factor and layout of the plurality of tentacles 110 may, or may not be equal. As long as the following: the length of tentacles 110 from the center of body 120, the relative horizontal angle among them and their moments; sums-up for sustaining the spinner 100 in balance while spinning. It should be noted that, the tentacles 110 expand the horizontal projection of the spinner 100 beyond the projection of its body 120. In some exemplary embodiments, each tentacle 110 of the plurality of tentacles 110 may comprise magnet 111 at its free end.

The left shell 130 and the right shell 140 may be connected to base 120, for example, by snapping to one another as well as the base 120. In some exemplary embodiments, left shell 130 and right shell 140 may together form a shape, such as a dome, a sphere, a cone, a pear, an insect abdomen, an insect thorax, an insect head, and any combination thereof, or the like. In some exemplary embodiments, base 120, left shell 130 and right shell 140 may encapsulate a spinning mechanism (to be described in detail further below) of spinner 100.

In some exemplary embodiments, spinner 100 may comprise a flywheel 122. Flywheel 122 may be a disk secured to the bottom of body 120 and connected to spindle 308 (to be described in detail further below) at its center. Flywheel 122 may comprise a tip 121 situated also at its center, however on the side opposite to where the spindle may be connected.

Flywheel 122 may be made of metal or other material that can add a substantial weight to the spinner 100. One of the properties of flywheel 122 may be sustaining rotational (spinning) energy, due to its resistance to spinning speed changes, a function of its moment of inertia, which is directly proportional to the flywheel 122 mass. In some exemplary embodiments, flywheel 122 may be utilized for sustaining longer spinning duration, since the amount of spinning energy in flywheel 122 is proportional to the square of its spinning speed. Thus, the heavier flywheel 122 is, the longer and faster it will spin. In some exemplary embodiments, the spinner 100 may be provided with at least one replaceable flywheel 122, which may be replaced for allowing reconfiguring the spinning speed and the spinning duration.

In some exemplary embodiments, the tip 121 may be made of a small hard material, such as ceramic, metal, glass and any combination thereof, or the like. The tip 121 may interact with the surface types, such as wood or any floor material, (excluding magnetic material in case magnets are incorporated within the spinner) upon which the game may be played. Additionally or alternatively, the tip 121 may be replaceable with tips suitable for different surface types. In some exemplary embodiments, spinner 100 may comprise a pulling handle 141, which may reside on right shell 140 and connected by string 142 of a spinning mechanism.

Figure 2:
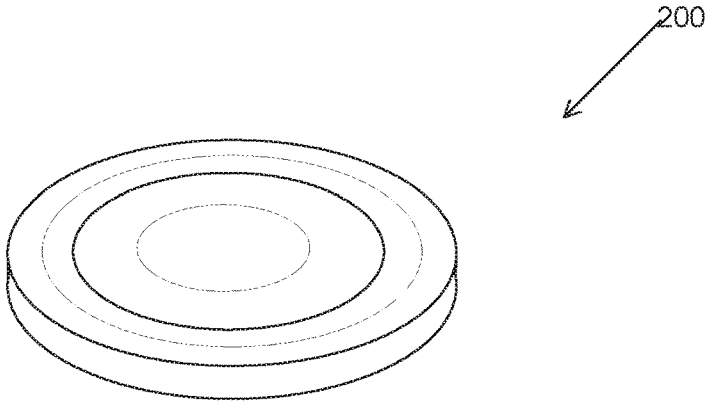
FIG. 2 shows a perspective view of a token, in accordance with some exemplary embodiments of the disclosed subject matter.

Referring now to FIG. 2, showing a perspective view of a token 200, in accordance with some exemplary embodiments of the disclosed subject matter. Token 200 may be a disc made of material, such as plastic, wood, cardboard, sheet-metal, and any combination thereof, or the like. In some exemplary embodiments, a portion of token 200 may have ferromagnetic properties configured to be attracted to the magnets of the spinner 100.

Additionally, or alternatively, token 200 may have a form factor of a ball, a pawn, an animal, a doll, a book, a smartphone, and any combination thereof, or any geometric shape.

In other exemplary embodiments, a portion of token 200 may comprise a round or squares lineal material surface having properties configured to be attracted to an opposing surface. It should be appreciated that, in such embodiment, the opposing surface substitute the magnets 111 of spinner 100 that are attached to the free end of the tentacle. These matching surfaces can be selected from a group of magnets, hook-and-loop fastener, or any other connectors that connect the surface of the token to the free end of the tentacle or to any other selected zone of the tentacle.

In some exemplary embodiments, the token 200 may slide over a surface, upon which the game is played, by the user which slides the token 200 towards the spinner 100. The token 200 thickness is adapted to allow the token 200 to slide between the surface and elevated tentacles 111. In some exemplary embodiments, when the token 200 comes in close proximity with a magnet of a tentacle 111, the token may be caught by the tentacle, however if the token 200 may not be attracted by magnet of a certain tentacle 111 then the token 200 may slide away from the spinner 100 or diverted to another direction by the spinning base.

In some exemplary embodiments, each token 200 of the plurality of tokens may be marked with either a positive or a negative, numerical value. Also, some tokens 200 may be marked as jokers. Additionally, or alternatively, tokens 200 may be graphically decorated with wild looking creatures, cartoon figures, animals, emojis, and any combination thereof, or the like.

In other exemplary embodiments, each token 200 of the plurality of tokens may be marked with letters, words, icons, sports figures, and any combination thereof, or the like, wherein each marking have an award significance or a value that effect a score. For example the icons may be trophies icons, such as flowers, cups, gold or silver coins, drinks, food and any combination thereof, or the like.

Figure 3:
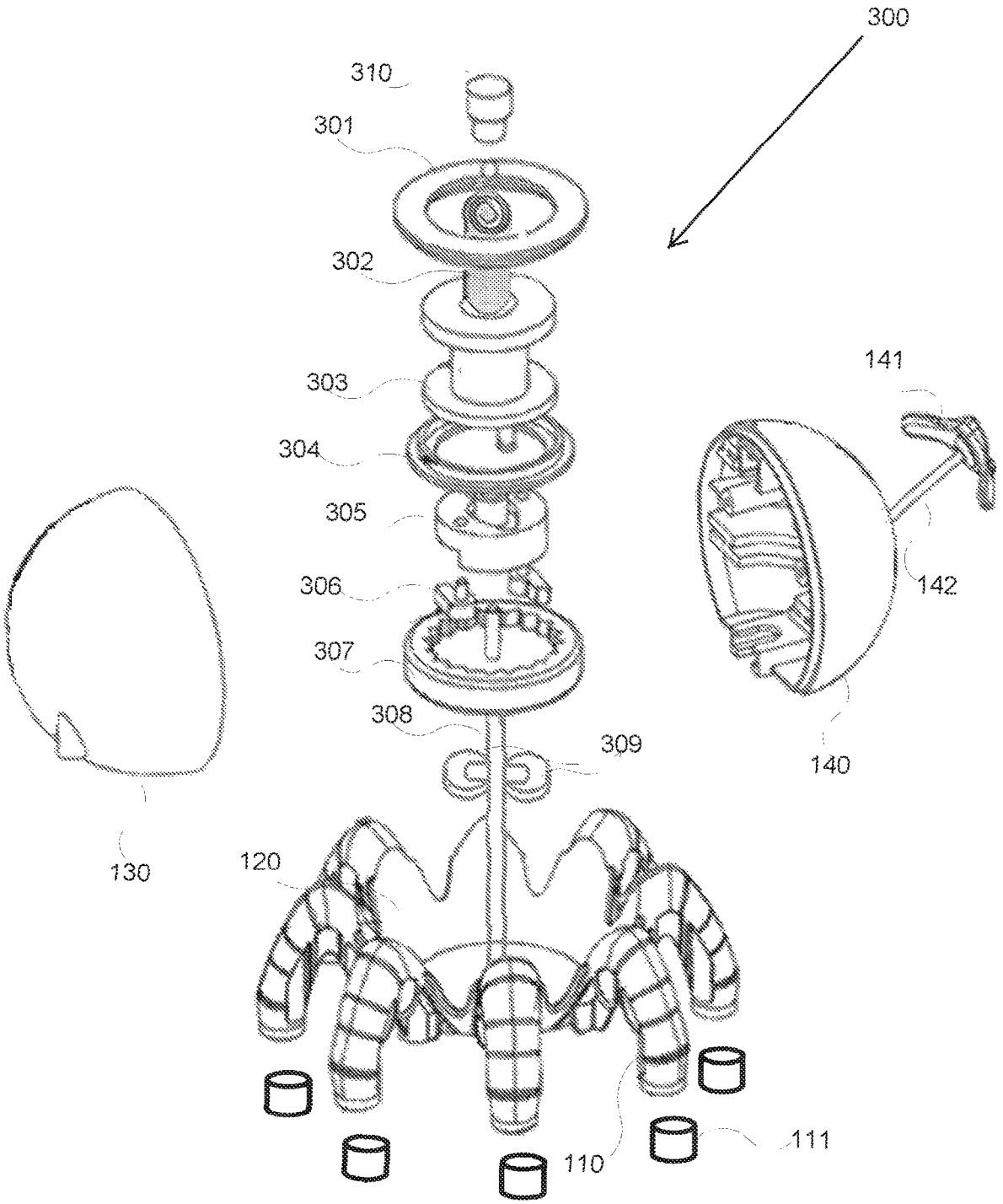
FIG. 3 shows an exploded view of a spinning mechanism of the spinner, in accordance with some exemplary embodiments of the disclosed subject matter.

Referring now to FIG. 3, showing an exploded view of a spinning mechanism 300 of the spinner 100, in accordance with some exemplary embodiments of the disclosed subject matter. A spinning mechanism may be used for spinning the spinner 100 rapidly while its tip 121 is in contact with the surface, wherein rotational inertia (of the spinning motion) causes the spinner 100 to remain balanced on its tip. In some exemplary embodiments, the kinetic energy that initially cause the spinner 100 to start spinning may be contributed by quick or vigorous twist; twirling a stem with fingers; pulling a string twisted around a spinning top; pushing an auger; and any combination thereof, or the like. In other exemplary embodiments, spinner 100 may incorporate an electro-mechanic spinning mechanism, such as a battery-operated DC motor or similar actuator, which may be remotely controlled by either a dedicated remote controller or from a smart phone application.

In some exemplary embodiments of the disclosed subject matter, spinner 100 may be spun by an integral spinning mechanism 300, which is encapsulated by base 120, left shell 130 and right shell 140 and activated by pulling string 142 with pulling handle 141. The spinner 100 may spin randomly around a spot, of the surface, on which a user spun it. However, upon interaction with tokens 200, the spinner 100 may wander about the surface while spinning.

At rest string 142 may be wrapped around spool 303. Upon pulling string 142, spool 303 may be rotated, thereby stretching spring 302, which may be situated within and connected to the spool 303. At the same time, driver 305, which may be connected by a ratchet mechanism to spool 303, can subsequently rotate spindle 308. In some exemplary embodiments, the ratchet mechanism may be comprised of driver 305, gear 307 and pawls 306. The ratchet mechanism may be configured to engage spindle 308 to driver 305, while string 142 is pulled, and disengage the spindle when the string 142 is released.

In some exemplary embodiments, upon release of string 142, pawls 306 may retract and thus disengaging driver 305 from the spool 303, which subsequently free spring 302 to rewind string 142 back on spool 303. It should be noted that, that spool 303 as well as spring 302 are incorporated together by bearings 301 and 304 for preventing wearing out the spool and enhancing the spinner 100 balance. In some exemplary embodiments, spindle 308 may be connected to flywheel 122, having a tip 121 at its opposite side, thus each time string 142 is pulled the flywheel 122 gains more spinning inertia. Spindle 308 may be supported by stabilizing bearings 309 also for enhancing the spinner 100 balance.

In some exemplary embodiments, base 120, left shell 130 and right shell 140 may connected together, for housing the spinning mechanism 300, by glue, screws, snap in to one another, and any combination thereof, or the like. Additionally, or alternatively, the spinner 100 may comprise a stem 310 for twirling the stem with fingers, i.e. spinning the spinner 100.

In some exemplary embodiments, the spinner 100 may be provided with at least one battery and LEDs (not shown), which may be illuminated as the spinner 100 spins.

Figure 4:
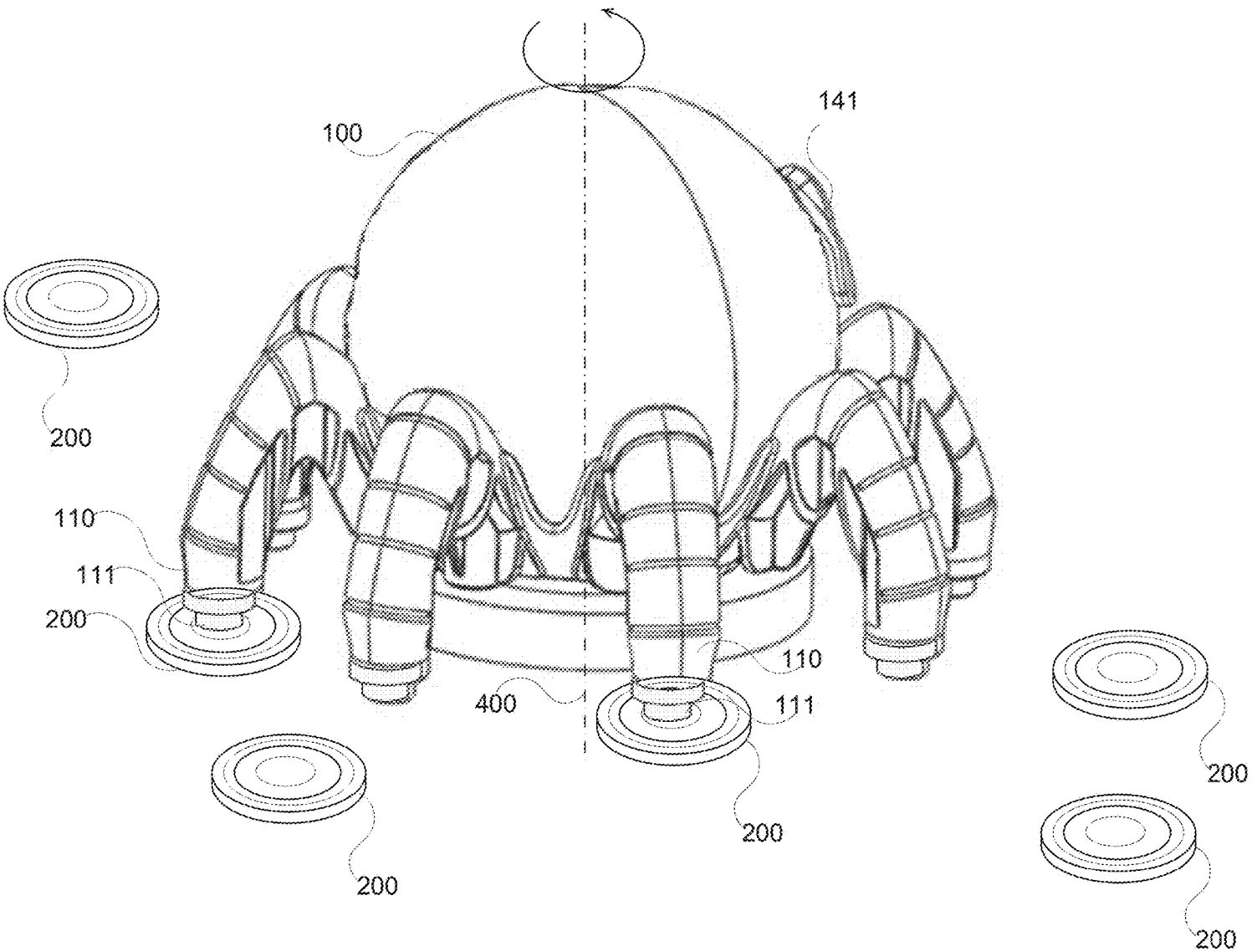
FIG. 4 shows a perspective view of the spinner, spinning while catching tokens, in accordance with some exemplary embodiments of the disclosed subject matter.

Referring now to FIG. 4, showing a perspective view of the spinner 100 spinning while catching tokens 200, in accordance with some exemplary embodiments of the disclosed subject matter.

The spin and catch game may be provided with at least one spinner 100 and a plurality of tokens 100, having different, positive or negative, numerical values, as well as jokers. In some exemplary embodiments, the game may be played on the floor or any surface, large enough, to accommodate the players, the plurality of tokens and the spinning spinner 100. Each player, in turn, spins the spinner 100, around axis 400, and letting it catch, with magnets 111, as many tokens 100, having positive value, for gaining the highest score in each turn. In some exemplary embodiments, players may spin the spinner 100 by pulling handle 141 that trigger the spinning mechanism 300, as depicted in FIG. 3.

It will be noted that, the magnets 111 attached to the free end of of tentacles 110 may be slightly elevated above the surface while the spinner 100 spins and tip 121 is in contact with the surface on which the game may be played.

Upon spinning the spinner, the player who spun the spinner 100 attempt to slide as many tokens 200 having positive face value toward spinner 100, at the same time the opponent players slide tokens 200 having negative face value toward spinner 100.

In some exemplary embodiments, in order for the tokens 200 to be caught by spinner 100, the tokens 200 may have slide under the magnets 111 of the spinner 100. It should be noted that, token 200 thickness is adapted to allow the token 200 to slide between the surface and magnets 111 of tentacles 110. In some exemplary embodiments, when the token 200 comes close proximity with a magnet of a tentacle 111, the token may be caught by the tentacle, however if the token 200 may not be attracted by magnet of a certain tentacle 111, the token 200 may slide away from the spinner 100 or may be diverted to another direction by the spinner 100.

In some exemplary embodiments, to decrease the player's score, the opponents may attempt to knock off tokens already caught by the spinner 100. Additionally, or alternatively, the opponents may attempt to divert tokens 200, slid by the player, away from the spinner 100.

In some exemplary embodiments, after the spinner 100 stops spinning, a score may be determined by summing the face value (negative and positive) of all the tokens caught in a turn. A joker token 200 may be a positive joker or a negative joker, for example a positive joker may grant the player with another turn, on the other hand a negative joker token 200 reset the score of the player in turn to zero. A winner may be the player who scored the highest number.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the disclosed subject matter.

The invention claimed is:

1. A method for playing a spin and catch game that comprises at least one spinner wherein each of the spinners is adapted to spin on a surface, and wherein the spinner comprises:

a spinning mechanism;

a plurality of tentacles, each having one end associated with the spinning mechanism and a free end provided with a connector; and a flywheel having a tip, wherein the flywheel is connected to the spinning mechanism on an opposite side of the tip, wherein activating the spinning mechanism causes the spinner to spin on the tip that is in contact with the surface and the plurality of tentacles are slightly elevated above the surface; and a plurality of tokens adapted to be connected by the connector while sliding on the surface under said plurality of tentacles when the spinner spins by players comprising a user and at least one opponent, the method comprising:

providing the user with at least one spinner and a plurality of tokens having positive value;

providing the at least one opponent with a plurality of tokens having negative value;

pulling a string to spin the spinner and placing the spinner on the surface wherein said tip is in contact with the surface and the plurality of tentacles are slightly elevated above the surface;

sliding the tokens on the surface towards the tentacles in order for the tokens to be caught by the connectors until the spinner stops spinning.

2. The method of claim 1, wherein the players take turns in spinning the spinner, and wherein a winning player is the player who accumulates a highest sum of values of tokens caught in a plurality of turns.

3. The method of claim 1, wherein the at least one opponent slides tokens having negative value to be caught by the connectors.

4. The method of claim 1, wherein the at least one opponent slides tokens having negative value to knock off tokens having positive value already caught by the connectors.

5. The method of claim 1, wherein one of the players slides a joker token to be caught by the connectors, and wherein catching the joker token grants the player an extra turn.

* * * * *